US005299630A

United States Patent [19]

Schatz

[11] Patent Number: 5,299,630

[45] Date of Patent: Apr. 5, 1994

[54] METHOD OF RAPIDLY HEATING A MASS TO AN OPERATIVE TEMPERATURE, IN PARTICULAR A VEHICLE ENGINE DURING COLD STARTING

[76] Inventor: Oskar Schatz, Waldpromenade 16, D-8035 Gauting, Fed. Rep. of Germany

[21] Appl. No.: 972,972

[22] Filed: Nov. 6, 1992

[30] Foreign Application Priority Data

Nov. 9, 1991 [DE] Fed. Rep. of Germany ..... 4136910

[51] Int. Cl.[5] ..... F28D 20/00

[52] U.S. Cl. ..... 165/10; 165/41; 165/104.11; 123/41.14

[58] Field of Search ..... 165/10, 104.11, 41; 123/41.14

[56] References Cited

U.S. PATENT DOCUMENTS 4,217,864 0/0000 Theodore .

FOREIGN PATENT DOCUMENTS 236386 6/1975 Fed. Rep. of Germany ... 123/41.14

3300946 7/1984 Fed. Rep. of Germany ... 123/41.14

OTHER PUBLICATIONS

BWK Brennstoff Warme Kraft Bd. 43, Nr. 6, Juni 1991, Düsseldorf de Seiten 333-337, O. Schatz "Latenwärmespeicher für Kaltstartverbesserung von Kraftfahrzeugen".

*Primary Examiner*—Albert W. Davis, Jr.

*Attorney, Agent, or Firm*—Harness, Dickey & Pierce

[57] ABSTRACT

A method of rapidly heating e.g. a vehicle engine to its operative temperature during cold starting periods. The vehicle engine is in heat exchange relationship with a section of a cooling fluid flow circuit which furthermore includes a sensible heat storage means. The heat carrier is fed into the heat storage means at the beginning of an inoperative period and is re-fed into said fluid flow circuit section in heat exchange relationship with the engine at the beginning of an operative period.

4 Claims, 1 Drawing Sheet

METHOD OF RAPIDLY HEATING A MASS TO AN OPERATIVE TEMPERATURE, IN PARTICULAR A VEHICLE ENGINE DURING COLD STARTING

BACKGROUND AND SUMMARY OF THE INVENTION

The invention relates to a method of rapidly heating a mass to an operative temperature, which mass is in heat exchange relationship with a section of a heat carrier system containing a flowable heat carrier and including a sensible heat storage means, in particular for rapidly heating a motor vehicle engine during cold starting.

It is well known that many technical processes, for optimal efficiency, require that the apparatus or system for performing such processes attain an operative temperature within a predetermined range. In this connection a heat carrier which may be a fluid or any other flowable matter, e.g. particulate matter circulating in a circuit in heat exchange relationship with such apparatus or system may be used for addition or removal of heat if desired. It has become known to include in such circuit a heat storage means for storing heat energy received from the heat carrier which has been heated to the operative temperature during operation of the apparatus or system. When operation of the apparatus or system has been interrupted and accordingly its temperature has approximated ambient temperature, the heat energy stored in the heat storage means may be used to rapidly heat the apparatus or system totally or partially to the optimal operative temperature. Depending on the type of the respective technical process and the operative temperature required thereby it is possible either to add heat energy when the operative temperature is above ambient temperature or to remove heat energy when the operative temperature is below ambient temperature.

A typical example for a process of the above mentioned type is the operation of an internal combustion engine, for example for automotive vehicles, requiring that the engine or at least essential parts thereof initially are heated to a minimum operative temperature after cold starting of the engine, whereafter an operative temperature is maintained by heat removal via a cooling medium circuit and an heat exchanger included therein until the engine is shut down. It has become known to use the heat energy to be removed from the engine to load a heat storage means which may provide heat energy during an operation period requiring heat, in particular during cold starting to thereby reduce wear, fuel consumption, exhaust gas emissions and noise and to improve cold starting and running characteristics of the engine and to enable early effective operation of the car heating.

It has been proposed to use latent heat storage elements or accumulators as a heat storage means because they are of substantial heat density, which is beneficial in particular in view of the low weight and small space requirements in automotive vehicles. On the other hand latent heat storage elements or accumulators are relatively expensive. Furthermore, heat storage means for storing sensible heat have become known, for example heat storage means which cooperate with liquid heat carriers by storing the usual cooling liquid of automotive vehicle engines. Such heat storage means allow for low costs and short loading and unloading times, however are of substantial weight and volume which makes it impossible or at least very difficult to use them in automotive vehicles.

Such "sensible heat storage means" wherein the heat energy is stored in the heat carrier which itself is stored in the heat storage means transfer their heat to the heat sink or an area to be heated by continuously circulating the heat carrier. From this results a balance temperature of a value between the temperature in the heat storage means and the temperature in the area to be heated at the beginning of an unloading period of the heat storage means, which balance temperature depends on the ratio of the heat active masses of the heat storage means and those of the area to be heated.

Accordingly, the heat energy removed from the heat storage means corresponds to the difference of the temperatures of the heat carrier within the heat storage means before and after the unloading period. In the case of internal combustion engines the temperature of the heat carrier prior to an unloading period results from the maximum admissible temperature, which in modern automotive vehicles normally is about 35° C. and the temperature drop of the heat carrier during the storing period, which temperature drop depends on the duration of the storage period and the heat losses of the heat storage means.

Because a certain minimum amount of heat energy to be transferred to the engine for obtaining a predetermined reduction of emissions is necessary in order to obtain the required increase of temperature of at least the relevant engine parts, it follows that the capacity of the heat storage means if dependent on the difference of temperatures before and after the unloading period. The higher the temperature difference, the lower are the space and weight requirements for the heat storage means.

It is an object of the present invention to improve a method of the above identified type so as to allow for an extremely rapid temperature change of the mass to be heated and to allow for a reduction of space and weight. It is a further object to enable an increase of the usable temperature difference of the heat storage means and to reduce the amount of heat energy to be added in respect of a certain engine operation.

In accordance with the present invention the heat carrier is fed into said heat storage means at the beginning of an inoperative period and is fed into said section of the carrier system no later than at the beginning of an operative period.

Contrary to the prior art the heat carrier system or circuit contains only an amount of the heat carrier that is sufficient to fill the functional area of the apparatus or system, which heat carrier amount is received in the functional area of the heat carrier system or circuit during operative periods, however within the heat storage means during inoperative periods; the remaining area of the heat carrier system or circuit is filled with air or another gas. From this results a substantial weight reduction. Furthermore, the total amount of heat carrier is maintained as closely as possible at the operative temperature by the heat insulation of the heat storage means during the inoperative periods so that it will be only the solid mass which is in heat exchange relationship with the heat carrier during operative periods that will attain a temperature according to ambient temperature during inoperative periods. At the beginning of operative periods the heat carrier is fed from the heat storage means into the functional area and will then transfer the total stored heat energy to the rigid mass in heat relationship with the heat carrier circuit without it being necessary to transfer some of the heat energy—as in the prior art methods—to the heat carrier that had remained in the functional area and attained a temperature approximating the ambient temperature.

A further development of the present invention provides that heat storage losses occurring during heat storing periods are compensated for by at least one latent heat storage element disposed in said heat storage means.

Another further development of the present invention provides that the heat carrier is fed through said heat storage means for loading said latent heat storage element when said mass has reached its operative temperature.

A still further development of the present invention provides that the heat carrier that has been fed into said heat storage means at the beginning of an inoperative period is re-fed into said section of the heat carrier system when said heat storage means has been heated up and/or said latent heat storage element has been loaded, and thereafter the heat carrier after having absorbed heat energy is again fed into said heat storage means.

A more detailed description of the invention will now be given in connection with the accompanying drawings.

BRIEF DESCRIPTION OF THE DRAWINGS

Similar or equivalent elements have been designated by the same reference numerals in the two figures.

Figure 1:
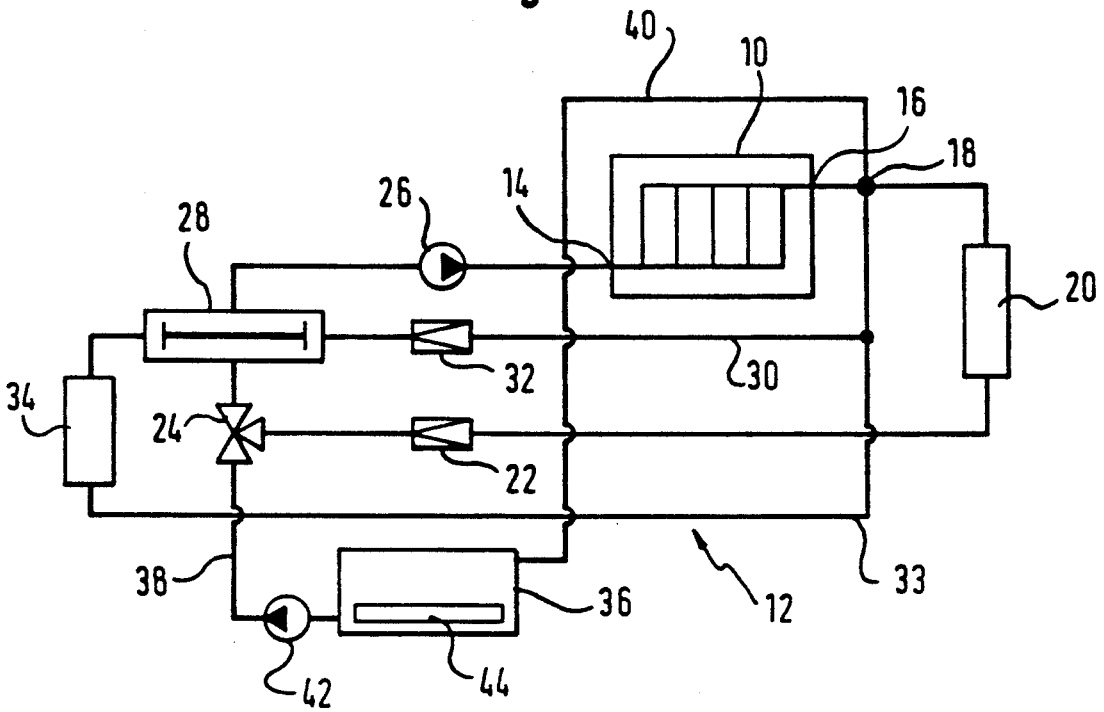
FIG. 1 is a schematic diagram of a cooling fluid system of an automotive vehicle internal combustion engine with the heat storage means being at a lower level and FIG. 2 is a schematic diagram of a cooling fluid system of an automotive vehicle internal combustion engine with the heat storage means being at an upper level.

An internal combustion engine 10 is included in a cooling fluid system 12, which is connected to the engine 10 via a cooling fluid inlet 14 and a cooling fluid outlet 16. The cooling fluid outlet 16 is followed by a junction 18 from which the cooling fluid flows to a cooling fluid pump 26 on the one hand via an air-controlled heating means 20, a check valve 22, and a three-way valve 24, and on the other hand, depending on the position of a thermostat valve 28, either via a line 30 and a check valve 32 or via a line 33 and a cooler :means 34. From pump 26 the cooling medium flows to the cooling fluid inlet 14.

Figure 2:
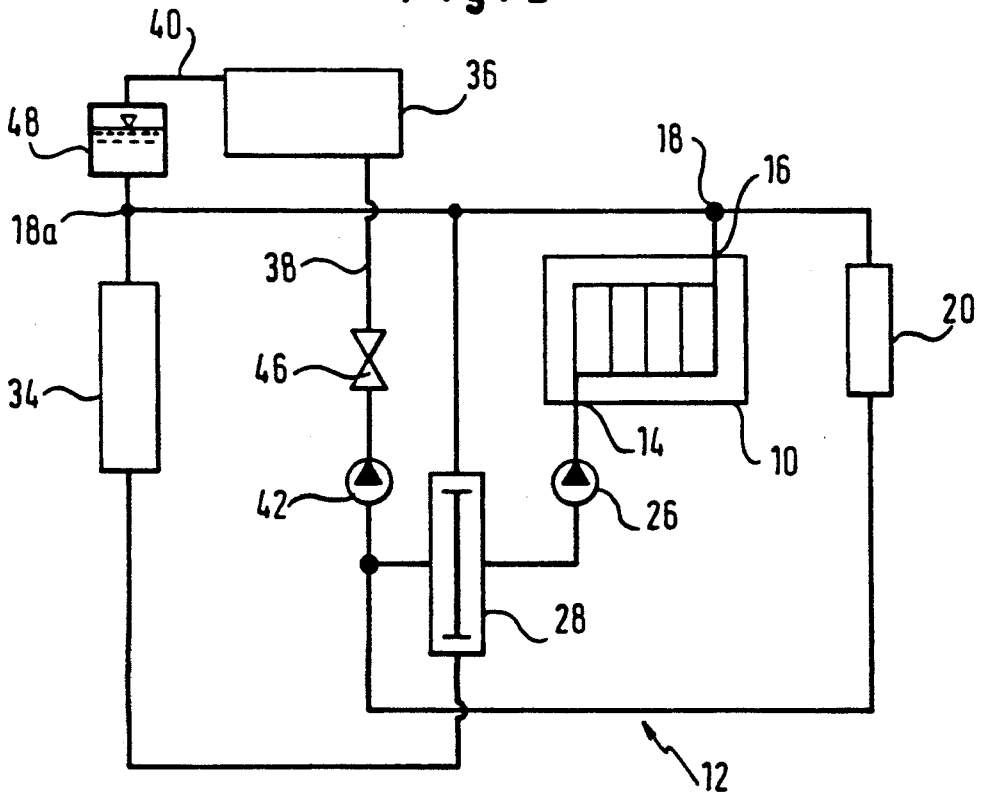

At the lowest level of the cooling fluid circuit there is provided a heat insulated heat storage means 36 being of a volume so that it may receive substantially all of the cooling fluid circulating through the engine 10 during operation thereof. The heat storage means 36 is connected to the three-way valve 24 via a fill and discharge line 38. Furthermore, an air line 40 extends from the upper area of the heat storage means 36 to the junction 18. The air line 40 may include a closure valve (not shown) which may be closed after the cooling fluid has been discharged from the heat storage means 36 into the cooling fluid circuit 12 passing through the engine 10 and after the cooling passages within engine 10 have been filled with the cooling fluid, and which may be opened when the heat storage means 36 is to be refilled with the cooling fluid. If such a closure valve is provided, a compensation container should be provided in the cooling fluid circuit 12 as shown in FIG. 2.

During inoperative periods of the engine 10 the cooling fluid is recieved in the heat storage means 36 while the cooling fluid circuit 12 in as much as it does not contain any cooling fluid contains air. When the engine 10 is started or shortly thereafter when there is cooling demand, an electric pump 42 in the fill and discharge line 38 withdraws the cooling fluid from the heat storage means 36 and feeds it into the cooling fluid circuit 12 through the three-way valve 24, which has been set for flow from the line 38 to the cooling fluid pump 26. This displaces and feeds the air via the line 40 into the heat storage means 36.

As soon as the cooling fluid has been discharged from the heat storage means 36, the three-way valve 24 is set for flow from check valve 22 to cooling fluid pump 26 so that the cooling fluid is retained within the cooling fluid circuit 12.

When the engine is stopped, the setting of the three-way valve 26 is changed so that the hot cooling fluid, under the influence of gravity, may flow back into the heat storage means 36 via line 38. This will transfer heat to the heat storage means 36. Furthermore, the heat storage means 36 may include a latent heat storage element 44, which also absorbs heat. In order to compensate for such heat loss, the electric pump 42 is again operated after a few minutes in order to re-feed the cooling fluid into the cooling fluid circuit 12 so as to absorb the remaining heat energy of the engine; thereafter the cooling fluid flows back into the heat storage means 36. Heat losses occurring during the heat storing periods may be compensated for by heat energy from the latent heat storage element for a certain time.

If, due to space restrictions, it is not possible to dispose the heat storage means 36 at a lower level, the arrangement of FIG. 2 may be used, wherein an "overhead" heat storage means 36 is disposed above the cooling fluid circuit 12. When the engine 10 has been placed out of operation, the cooling fluid is fed from the cooling fluid circuit 12 by the electric pump 12 through the fill and discharge line 38 into the heat storage means 36. Thereafter, backflow of the cooling fluid into the cooling fluid circuit 12 is prevented by closing a closure valve 46 during the heat storage period. The air flows from the heat storage means 36 through the air line 40 and a compensation container 48 to a junction **18*a*** and from there into the cooling fluid circuit.

I claim:

1. A method of rapidly heating a mass to an operative temperature, which mass is in heat exchange relationship with a section of a heat carrier system containing a flowable heat carrier and including a sensible heat storage means, in particular for rapidly heating a motor vehicle engine during cold starting, comprising:

providing a valve means in said heat carrier system for controlling flow of said flowable heat carrier;

feeding the heat carrier via said valve means into said heat storage means at the beginning of an inoperative period;

feeding said heat carrier via said valve means into said section of the carrier system no later than at the beginning of an operative period; and controlling air flow into said heat storage means via a conduit means coupled between said heat storage means and said carrier system.

2. A method as claimed in claim 1, wherein heat storage losses occurring during heat storing periods are compensated for by at least one latent heat storage element disposed in said heat storage means.

3. A method as claimed in claim 2, wherein the heat carrier is fed through said heat storage means for loading said latent heat storage element when said mass has reached its operative temperature.

4. A method as claimed in claim 2, wherein the heat carrier that has been fed into said heat storage means at the beginning of an inoperative period is re-fed into said section of the heat carrier system when said heat storage means has been heated up and/or said latent heat storage element has been loaded, and thereafter the heat carrier after having absorbed heat energy is again fed into said heat storage means.

* * * * *

UNITED STATES PATENT AND TRADEMARK OFFICE

CERTIFICATE OF CORRECTION

PATENT NO. : 5,299,630

DATED : April 5, 1994

INVENTOR(S) : Oskar Schatz

It is certified that error appears in the above-indentified patent and that said Letters Patent is hereby corrected as shown below:

On Title Page under Foreign Patent Documents, "236386" should be --2363686--;

On Title Page under U.S. Patent Documents, "0/000" should be --8/1980--;

On Title Page under Other Publications,"Latenwärmespeicher" should be --Latentwarmespeicher--;

Col. 1, Line 46, "an" should be --a--;

Col. 2 Line 32, "if" should be --is--;

Col. 3, Line 33, after "level" insert --;--;

Col. 3, Line 50, ":means" should be --means--;

Col. 4, Line 21, "26" should be --24--; and

Col. 4, Line 41, "12" should be --42--. (second occurrence)

Signed and Sealed this

First Day of November, 1994

*Attest:*

*Attesting Officer*

Bruce Lehman

BRUCE LEHMAN

*Commissioner of Patents and Trademarks*